US011308899B2

(12) United States Patent
Wang

(10) Patent No.: US 11,308,899 B2
(45) Date of Patent: Apr. 19, 2022

(54) METHOD AND DEVICE FOR DRIVING A DISPLAY PANEL, AND A DISPLAY DEVICE

(71) Applicant: HKC Corporation Limited, Guangdong (CN)

(72) Inventor: Mingliang Wang, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 16/982,072

(22) PCT Filed: Dec. 25, 2018

(86) PCT No.: PCT/CN2018/123357
§ 371 (c)(1),
(2) Date: Sep. 18, 2020

(87) PCT Pub. No.: WO2020/118767
PCT Pub. Date: Jun. 18, 2020

(65) Prior Publication Data

US 2021/0104201 A1 Apr. 8, 2021

(30) Foreign Application Priority Data

Dec. 12, 2018 (CN) ..... 201811519105.2

(51) Int. Cl.
*G09G 3/36* (2006.01)

(52) U.S. Cl.
CPC ..... *G09G 3/3607* (2013.01); *G09G 2320/02* (2013.01); *G09G 2320/0666* (2013.01); *G09G 2320/0673* (2013.01); *G09G 2340/06* (2013.01)

(58) Field of Classification Search
None
See application file for complete search history.

(56) References Cited

U.S. PATENT DOCUMENTS

2008/0024473 A1* 1/2008 Hsu ..... G09G 3/3648 345/204
2009/0027598 A1* 1/2009 Ikeno ..... G09G 3/3611 349/77

(Continued)

FOREIGN PATENT DOCUMENTS

CN 1603902 A 4/2005
CN 1613104 A 5/2005

(Continued)

OTHER PUBLICATIONS

1st Office Action of counterpart Chinese Patent Application No. 201811519105.2 dated Jan. 6, 2020.

(Continued)

*Primary Examiner* — Benjamin C Lee
*Assistant Examiner* — Emily J Frank

(57) ABSTRACT

The present disclosure discloses a method and a device for driving a display panel, and a display device. The method includes: obtaining a first difference value by comparing a current frame original data with the previous frame original data, and standardizing the first difference value to obtain a standard difference value; comparing a processed data of the current frame obtained by the color processing with a processed data of the previous frame to obtain a second difference value, comparing the magnitude of the standard difference value with the magnitude of the second difference value, and outputting a corresponding data according to the comparison result, to drive a data output from a chip for driving the display panel.

17 Claims, 3 Drawing Sheets

(56) References Cited

U.S. PATENT DOCUMENTS

| | | | | |
|---|---|---|---|---|
| 2009/0109247 | A1* | 4/2009 | Kimura | G09G 3/3688 345/690 |
| 2012/0002877 | A1* | 1/2012 | Takahashi | H04N 1/4486 382/195 |
| 2012/0162159 | A1 | 6/2012 | Kim et al. | |
| 2012/0169784 | A1* | 7/2012 | Lee | G09G 3/2011 345/690 |
| 2013/0076769 | A1 | 3/2013 | Park et al. | |
| 2015/0235600 | A1* | 8/2015 | Inada | G09G 3/3614 345/691 |

FOREIGN PATENT DOCUMENTS

| | | | |
|---|---|---|---|
| CN | 1924970 | A | 3/2007 |
| CN | 1936653 | A | 3/2007 |
| CN | 101089940 | A | 12/2007 |
| CN | 101615374 | A | 12/2009 |
| CN | 102592555 | A | 7/2012 |
| CN | 102934156 | A | 2/2013 |
| CN | 103021322 | A | 4/2013 |
| CN | 104317085 | A | 1/2015 |
| CN | 105225648 | A | 1/2016 |
| CN | 105304031 | A | 2/2016 |
| CN | 105448263 | A | 3/2016 |
| CN | 106028014 | A | 10/2016 |
| CN | 106782403 | A | 5/2017 |
| CN | 107799053 | A | 3/2018 |
| CN | 108648692 | A | 10/2018 |
| JP | H07121137 | A | 5/1995 |
| JP | 2008113330 | A | 5/2008 |
| KR | 1020060059316 | A | 6/2006 |
| TW | 200915267 | A | 4/2009 |
| TW | 201612883 | A | 4/2016 |

OTHER PUBLICATIONS

International Search Report of PCT Patent Application No. PCT/CN2018/123357 dated Oct. 9, 2019.

* cited by examiner

METHOD AND DEVICE FOR DRIVING A DISPLAY PANEL, AND A DISPLAY DEVICE

TECHNICAL FIELD

The present disclosure relates to the technical field of display, particularly, to a method and a device for driving a display panel, and a display device.

BACKGROUND

At present, the display architecture of a television set usually includes a SOC (single on chip) chip on the main board and a T-CON (Timing Controller) chip on the control board. The image input signal of the display architecture is usually input by an antenna or a set top box, then the signal is transmitted to the T-CON chip on the control board for processing again after being processed by the SOC chip, and finally the data driving chip is used to drive the liquid crystal panel. The SOC chip and the T-CON chip are usually communicatively connected through a Low-Voltage Differential Signaling (LVDS) transmission protocol, and the SOC chip encodes the transmitted image signal according to the protocol and transmits the encoded signal to the T-CON chip for a series of color processing, and finally, transmits the processed signal to the driving unit to drive the liquid crystal display panel. In this process, after the image input signal is processed by the SOC chip and the T-CON chip, the signal is changed greatly; especially for the static picture display, the data displayed twice before and after the same display position will become completely different, and the more the color processing steps, the greater the difference, and the problem of flickering of the image is likely to occur.

SUMMARY

The embodiment of the present disclosure solves the problem that the liquid crystal display panel is prone to screen flickering in the existing art by providing a method and a device for driving a display panel, and a display device.

The embodiment of the present disclosure provides a method for driving a display panel which includes the steps of:

receiving an original image signal, and comparing a difference between a current frame original data and a previous frame original data of the original image signal to obtain a first difference value;

performing a multi-level color processing on the current frame original data to obtain a processed data of the current frame; meanwhile converting the first difference value to a standard difference value through a standard conversion;

determining whether the standard difference value is greater than or equal to a preset value, and if yes, outputting the processed data of the current frame; if not, determining an output data according to an offset range of the processed data of the current frame; and driving the display panel according to the output data.

Optionally, the step of determining an output data according to the offset range of the processed data of the current frame specifically includes:

comparing a difference between the processed data of the current frame and a processed data of the previous frame to obtain a second difference value; and comparing a magnitude of the standard difference value and that of the second difference value, determining that the offset range of the processed data of the current frame is small when the standard difference value is greater than or equal to the second difference value, and directly outputting the processed data of the current frame; determining that the offset range of the processed data of the current frame is large when the standard difference value is smaller than the second difference value, and outputting a data obtained by performing an offset correction on the processed data of the previous frame.

Optionally, the step of outputting a data obtained by performing an offset correction on the processed data of the previous frame specifically includes:

adding or subtracting the first difference value to or from the processed data of the previous frame as a corrected data, and outputting the corrected data.

Optionally, the step of performing a multi-level color processing on the current frame original data to obtain a processed data of the current frame specifically includes:

a color processing, performing the color processing on the current frame original data to obtain a first-level processed data of the current frame;

a digital gamma processing, performing the digital gamma processing on the current frame original data to obtain a second-level processed data of the current frame; and a dither processing, performing the dither processing on the current frame original data to obtain a third-level processed data of the current frame.

Optionally, the current frame original data is subjected to the color processing, the digital gamma processing, and the dither processing to obtain the processed data of the current frame; and the previous frame original data is subjected to the above three-level color processing to obtain the processed data of the current frame.

Optionally, the step of the digital gamma processing specifically includes:

digitally adjusting a transmitted image data, and editing a gamma curve of the image data to perform nonlinear tone editing on the image; and detecting a dark portion and a light portion in the image signal, and increasing the ratio of the two.

Optionally, the step of converting the first difference value to a standard difference value through a standard conversion specifically includes:

obtaining a current gray-scale range of the current frame original data; and obtaining a standard difference value corresponding to the first difference value by querying a standard table according to the current gray-scale range and the first difference value.

Optionally, after the step of receiving an original image signal, and comparing a difference between a current frame original data and a previous frame original data of the original image signal to obtain a first difference value, the method further includes:

combining the current frame original data and the first difference value, and transmitting the combined data according to a preset protocol code, then decoding the combined data to separate the current frame original data from the first difference value.

Optionally, the step of combining the current frame original data and the first difference value, and transmitting the combined data according to a preset protocol code, then decoding the combined data to separate the current frame original data from the first difference value, specifically includes: first dividing, by the color, the current frame original data to include a red primary color data, a green primary color data, and a blue primary color data, each of the primary color data has 8 bits, the red primary color data includes AR0 to AR7, the green primary color data includes AG0 to AG7, and the blue primary color data includes AB0 to AB7; dividing, by the color, the first difference value to include a red primary color data difference, a green primary color data difference, and a blue primary color data difference, each of the primary color data differences has 3 bits.

Optionally, the predetermined protocol is a low voltage differential signaling transmission protocol, and the low voltage differential signaling includes 4 pairs of differential signals corresponding to the current frame original data and 1 pair of differential signals corresponding to the first difference value.

The embodiment of the present disclosure further provides a device for driving a display panel which includes:

a main control chip, configured to receive an original image signal, and compare a difference between a current frame original data and a previous frame original data of the original image signal to obtain a first difference value; combine the current frame original data and the first difference value, and transmit the combined data according to a predetermined code;

a timing control chip, communicatively connected to the main control chip through the predetermined protocol, and configured to: receive the combined data and decode the combined data to separate the current frame original data from the first difference value; perform a multi-level color processing on the current frame original data to obtain a processed data of the current frame; convert the first difference value to a standard difference value through a standard conversion; determine whether the standard difference value is greater than or equal to a preset value, and if yes, output the processed data of the current frame; if not, compare a difference between the processed data of the current frame and the processed data of the previous frame to obtain a second difference value; compare a magnitude of the standard difference value and that of the second difference value, determine that an offset range of the processed data of the current frame is small, when the standard difference value is greater than or equal to the second difference value, and directly output the processed data of the current frame; determine that the offset range of the processed data of the current frame is large when the standard difference value is smaller than the second difference value, and add or subtract the first difference value to or from the processed data of the previous frame as a corrected data, and output the corrected data; and a driving chip, connected to an output end of the timing control chip, and configured to drive the display panel according to data output by the timing control chip.

Optionally, the standard conversion process includes obtaining a current gray-scale range of the current frame original data, and obtaining a standard difference value corresponding to the first difference value by querying a standard table according to the current gray-scale range and the first difference value.

Optionally, the predetermined protocol is a low voltage differential signaling transmission protocol, and the low voltage differential signaling includes 4 pairs of differential signals corresponding to the current frame original data and 1 pair of differential signals corresponding to the first difference value.

The embodiment of the present disclosure further provides a display device, the display device includes a display panel and the device for driving the display panel as described above; the device for driving the display panel includes:

a main control chip, configured to receive an original image signal, and compare a difference between a current frame original data and a previous frame original data of the original image signal to obtain a first difference value; combine the current frame original data and the first difference value, and transmit the combined data according to a predetermined code;

a timing control chip, communicatively connected to the main control chip through the predetermined protocol, and configured to: receive the combined data and decode the combined data to separate the current frame original data from the first difference value; perform a multi-level color processing on the current frame original data to obtain a processed data of the current frame; convert the first difference value to a standard difference value through a standard conversion; determine whether the standard difference value is greater than or equal to a preset value, and if yes, output the processed data of the current frame; if not, compare a difference between the processed data of the current frame and the processed data of the previous frame to obtain a second difference value; compare a magnitude of the standard difference value with that of the second difference value, determine that an offset range of the processed data of the current frame is small, when the standard difference value is greater than or equal to the second difference value, and directly output the processed data of the current frame; determine that the offset range of the processed data of the current frame is large when the standard difference value is smaller than the second difference value, and add or subtract the first difference value to or from the processed data of the previous frame as a corrected data, and output the corrected data; and, a driving chip, connected to an output end of the timing control chip, and configured to drive the display panel according to data output by the timing control chip.

Optionally, the standard conversion process includes obtaining a current gray-scale range of the current frame original data, and obtaining a standard difference value corresponding to the first difference value by querying a standard table according to the current gray-scale range and the first difference value.

Optionally, the predetermined protocol is a low voltage differential signaling transmission protocol, and the low voltage differential signaling includes 4 pairs of differential signals corresponding to the current frame original data and 1 pair of differential signals corresponding to the first difference value.

Optionally, the step of the timing controller being configured to determine the output data according to the offset range of the processed data of the current frame specifically includes:

comparing the difference between the processed data of the current frame and the processed data of the previous frame to obtain the second difference value; and comparing the magnitude of the standard difference value with that of the second difference value, determining that the offset range of the processed data of the current frame is small when the standard difference value is greater than or equal to the second difference value, and directly outputting the processed data of the current frame; determining that the offset range of the processed data of the current frame is large when the standard difference value is smaller than the second difference value, and outputting the data obtained by performing offset correction on the processed data of the previous frame.

Optionally, the step of the timing controller being configured to output the data obtained by performing offset correction on the processed data of the previous frame specifically includes:

adding or subtracting the first difference to or from the processed data of the previous frame as a corrected data, and outputting the corrected data.

One or more technical solutions of the embodiment of the present disclosure has at least one or more following technical effects:

by comparing the current frame original data with the previous frame original data to obtain a first difference value through the main control chip, and transmitting the first difference value and the current frame original data to the timing control chip, standardizing the first difference value to obtain a standard difference value through the timing control chip; and by comparing the processed data of the current frame obtained by the color processing with the processed data of the previous frame to obtain a second difference value, comparing the magnitude of the standard difference value with the magnitude of the second difference value, outputting a corresponding driving signal to the display panel according to the data outputted by the timing control chip through the driving chip; then, through above solutions, the processing effect of the data received by the display panel may be ensured when the transmitted image is a static image, and the flickering problem of the display panel may be solved.

BRIEF DESCRIPTION OF THE DRAWINGS

In order to illustrate the technical solutions in the embodiments of the present disclosure or in the prior art more clearly, the drawings which are required to be used in the description of the embodiments of the present disclosure or the prior art are briefly described below. It is obvious that the drawings described below are only some embodiments of the present disclosure. It is apparent to those of ordinary skill in the art that other drawings may be obtained based on the structures shown in accompanying drawings without inventive effort.

The object realization, function characteristics and advantages of this application will be further described in reference to embodiments and accompanying drawings.

DETAILED DESCRIPTION OF THE EMBODIMENTS

The technical solutions in the embodiments of the present disclosure will be clearly and completely described hereafter in reference to the drawings in the embodiments of the present disclosure. It is apparent that the described embodiments are merely a part of embodiments rather than all the embodiments of the present disclosure. All the other embodiments obtained by the artisans concerned on the basis of the embodiments in the present disclosure without creative efforts fall within the scope of claims of the present disclosure.

It is to be understood that, all of the directional instructions in the exemplary embodiments of the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, a feature indicated by the "first", the "second" can express or impliedly include at least one of the features. In addition, the technical solutions of various embodiments may be combined with each other only on the basis that a person skilled in the art can realize the combination; when the combination of the technical solutions contradicts each other or is impossible to realize, the combination of the technical solutions should be considered to be non-existent, nor is not in the protection scope claimed by the present disclosure.

Figure 1:
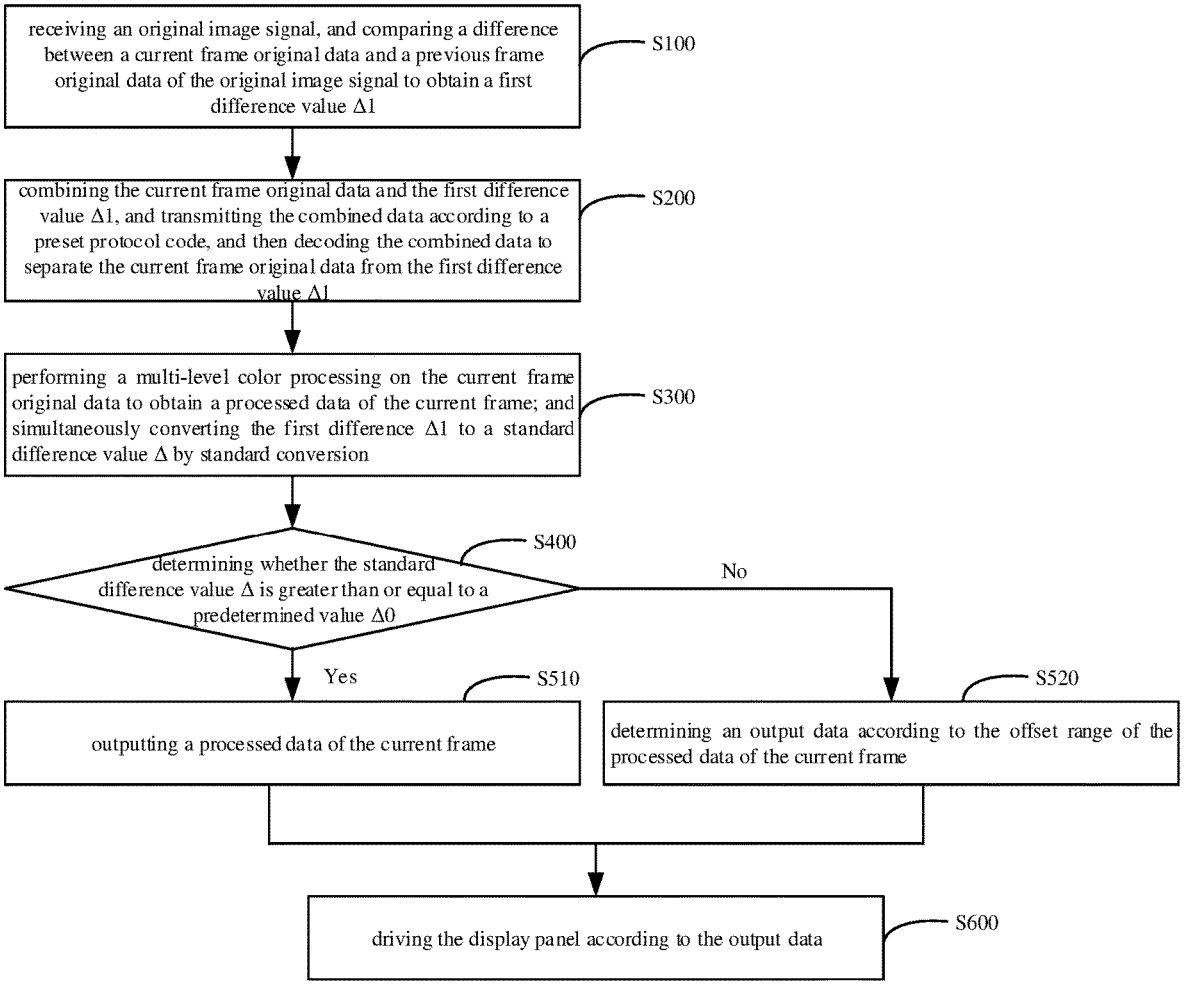
FIG. 1 is a flow chart of a method for driving a display panel according to an embodiment of the present disclosure.

Referring to FIG. 1, the embodiment of the present disclosure provides a method for driving a display panel.

In an embodiment, the method includes the steps of:

step S100: receiving an original image signal, and comparing a difference between a current frame original data and a previous frame original data of the original image signal to obtain a first difference value $\Delta 1$;

step S200: combining the current frame original data and the first difference value $\Delta 1$, and transmitting the combined data according to a preset protocol code, then decoding the combined data to separate the current frame original data from the first difference value $\Delta 1$;

step S300: performing a multi-level color processing on the current frame original data to obtain a processed data of the current frame; and simultaneously converting the first difference value $\Delta 1$ to a standard difference value $\Delta$ by standard conversion;

step S400: determining whether the standard difference value $\Delta$ is greater than or equal to a predetermined value $\Delta 0$;

step S510: if yes, outputting a processed data of the current frame;

step S520: if no, determining an output data according to the offset range of the processed data of the current frame; and step S600: driving the display panel according to the output data.

Figure 2:
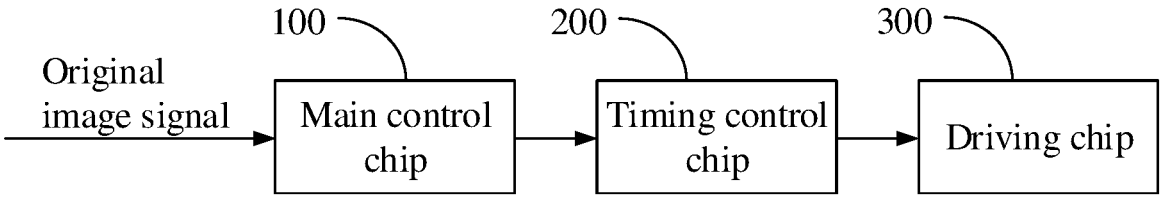
FIG. 2 is a block diagram of a device for driving a display panel according to an embodiment of the present disclosure.

In the present embodiment, referring to FIG. 2, the display panel can be a liquid crystal display panel of an electronic device having a display function, such as a television or a computer. The method is formed based on a device for driving the liquid crystal display panel. Taking the television as an example, the driving device of the display panel is mainly constituted by sequentially connecting a main control chip 100 on the main board of the television, a timing control chip 200 on the control board, and a driving chip 300. The main control chip 100 and the timing control chip 200 are communicatively connected through a Low-Voltage Differential Signaling (LVDS) transmission protocol.

Optionally, the input end of the main control chip 100 is configured to receive the current frame original data of the original image signal, and the original image signal is usually input by an antenna or a set top box; the main control chip 100 is configured to store the previous frame original data of the original image signal, and compare the previous frame original data with the current frame original data to obtain the difference value which can be defined as the first difference value Δ1; then the main control chip 100 is configured to combine the current frame original data with the first difference value Δ1 and encodes the above combined data for transmitting in accordance with LVDS transmission protocol.

Among them, the low voltage differential signaling of the LVDS transmission protocol includes 4 pairs of differential signals corresponding to the current frame original data and 1 pair of differential signals corresponding to the first difference value.

Optionally, the color of the current frame original data may also be initially processed before the current frame original data and the first difference value Δ1 are combined and encoded for transmission.

Figure 3:
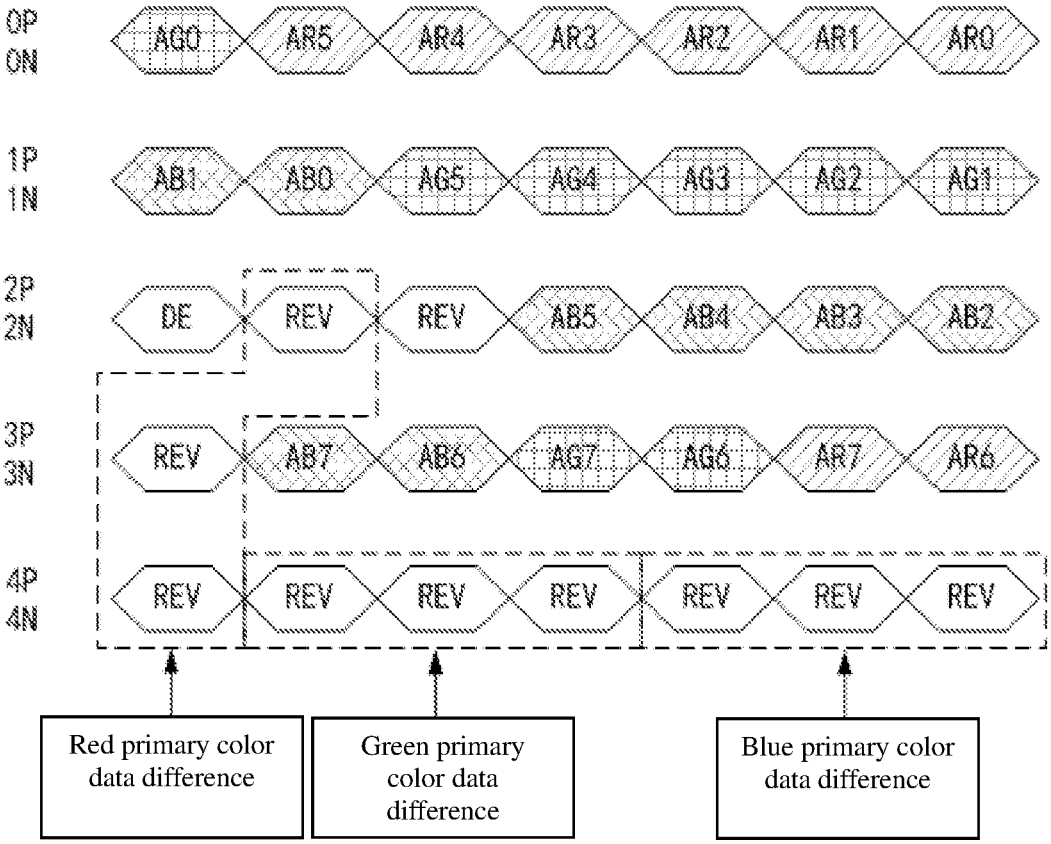
FIG. 3 is a coding diagram of low-voltage differential signaling transmission protocol of a driving device of the display panel of the present disclosure.

Referring to FIG. 3, in the step S200, combining the current frame original data and the first difference value Δ1, and encoding the above combined data according to LVDS transmission protocol specifically includes: first dividing, by the color, the current frame original data to include red primary color data, green primary color data, and blue primary color data, each of the primary color data has 8 bits, the red primary color data includes AR0 to AR7, the green primary color data includes AG0 to AG7, and the blue primary color data includes AB0 to AB7; dividing, by the color, the first difference value Δ1 to include a red primary color data difference, a green primary color data difference, and a blue primary color data difference, each of the primary color data differences has 3 bits.

In this embodiment, the first pair of differential signals (0P, 0N) sequentially transmit AR0 to AR5 of red primary color data and AG0 of green primary color data; the second pair of differential signals (1P, 1N) sequentially transmit AG0 to AG5 of green primary color data and AB0 to AB1 of blue primary color data; the third pair of differential signals (2P, 2N) sequentially transmit AB2 to AB5 and an enable signal DE of the blue primary color data, and there are two reserved data bits REV between the enable signal DE and AB5 of the blue primary color data; the fourth pair of differential signals (3P, 3N) sequentially transmit AR6 to AR7 of red primary color data, AG6 to AG7 of green primary color data, and AB6 to AB7 of blue primary color data, and one reserved data bit REV is left; the fifth pair of differential signals (4P, 4N) are all reserved data bits REV; then, the red primary color data difference, the green primary color data difference, and the blue primary color data difference are jointly transmitted through 7 reserved data bits REV of the fifth pair of differential signals (4P, 4N), 1 reserved data bit REV of the fourth pair of differential signals (3P, 3N), and 1 reserved data bit REV of the third pair of differential signals (2P, 2N).

Further, each primary color data difference may be expressed in binary, then every three bits may represent 8 kinds of data difference (0 to 7), which may be corresponding according to the following coding forms: 000 indicates that the primary color data difference is 0, 001 indicates that the primary color data difference is 1, 010 indicates that the primary color data difference is 2, 011 indicates that the primary color data difference is 3, 100 indicates that the primary color data difference is 4, 101 indicates that the primary color data difference is 5, 110 indicates that the primary color data difference is 6, and 111 indicates that the primary color data difference is 7; when the data difference is greater than 7, it also defaults to 7. For example, when the red primary color data difference is 2, the red primary color data difference transmission bit is correspondingly 010; when the green primary color data difference is 4, the green primary color data difference transmission bit is correspondingly 100; when the blue primary color data difference is 1, the blue primary color data difference transmission bit is correspondingly 001; the first difference value Δ1 is determined by referring to the aforementioned encoding rule for each of the primary color data differences, which is not mentioned here by examples.

After the current frame original data is coded with the first difference value Δ1 according to the above protocol, the coded data is transmitted to the timing controller 200, then the coded data is decoded according to LVDS transmission protocol to separate the current frame original data from the first difference value Δ1, then the current frame original data is subjected to the multi-level color processing, and the first difference value Δ1 is subjected to standard conversion processing.

Multi-level color processing may employ many forms. In the present embodiment, taking the multi-level color processing process including a color processing, a digital gamma processing, and a dither processing which are sequentially performed as an example, this multi-level color processing process is not limited to the form exemplified in the present embodiment. The color processing is configured to improve the color vividness of the transmitted image data; the digital gamma processing digitally adjusts the transmitted image data, edits a gamma curve of the image data to perform nonlinear tone editing on the image, detects a dark portion and a light portion of the image signal, and increases the ratio of the two, thereby improving the image contrast effect; the dither process is configured for de-dithering processing, displaying more gray levels, and making the image transition smoother; when current frame original data is subjected to the above three-level color processing process to obtain the processed data a of the current frame, the previous frame original data is subjected to the above-described three-level color processing to obtain the processed data b of the previous frame.

In the present embodiment, the standard conversion process for the first difference value Δ1 is to first obtain the current gray-level range of the current frame original data; the query operation is performed according to the current gray-scale range based the standard table shown in the following table, then a corresponding standard difference value Δ is obtained.

TABLE 1

| | standard difference value Δ under the gray-scale | | | |
|---|---|---|---|---|
| first difference value Δ1 | 10-50 | 51-130 | 131-190 | 191-255 |
| 0 | 0 | 0 | 0 | 0 |
| 1 | 1 | 1 | 2 | 2 |
| 2 | 2 | 2 | 3 | 3 |
| 3 | 3 | 4 | 5 | 5 |
| 4 | 4 | 5 | 6 | 7 |
| 5 | NA | NA | NA | NA |
| 6 | NA | NA | NA | NA |
| 7 | NA | NA | NA | NA |

In the standard table, NA in the column of each standard difference value Δ represents that the image difference is too large and is not processed; in the present embodiment, the predetermined value Δ0 is set to 5, and when the first difference value Δ1 is greater than or equal to 5, it is considered that the difference in image changes is too large to be processed; that is to say, the current image is a dynamic image, and the output processed data of the current frame is directly transmitted to the driving chip 300, and the driving chip 300 outputs a corresponding driving signal to the display panel according to the data.

Figure 4:
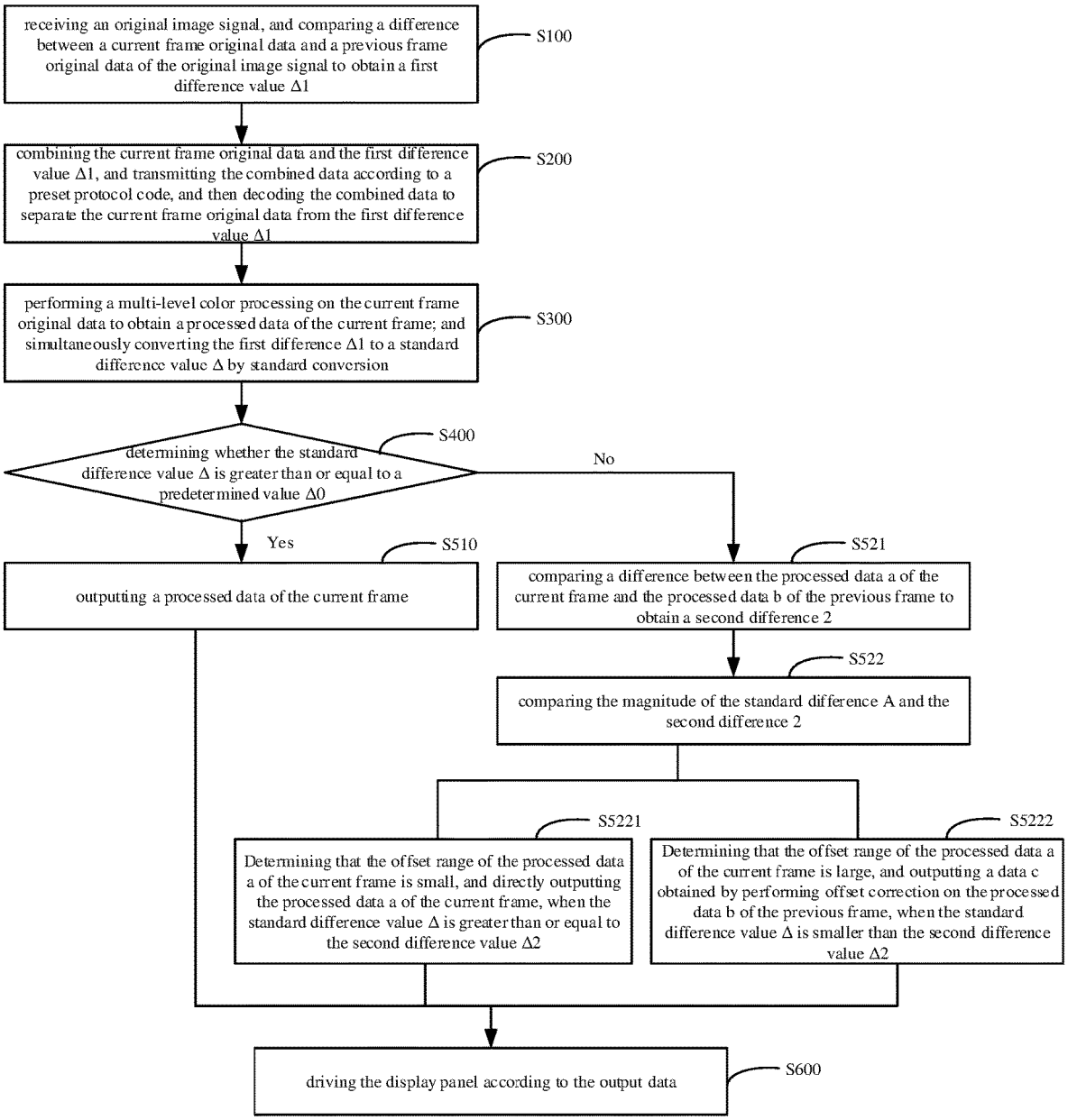
FIG. 4 is a flow chart of a method for driving a display panel according to another embodiment of the present disclosure.

Referring to FIG. 4, if the first difference value Δ1 is less than 5, it is determined that the current image is a static image, and step S520 is implemented as follows:

step S521: comparing a difference between the processed data a of the current frame and the processed data b of the previous frame to obtain a second difference value Δ2;

step S522: comparing a magnitude of the standard difference value Δ with that of the second difference value Δ2;

step S5221: determining that the offset range of the processed data a of the current frame is small when the standard difference value Δ is greater than or equal to the second difference value Δ2, and directly outputting the processed data a of the current frame; and step S5222: determining that the offset range of the processed data a of the current frame is large when the standard difference value Δ is smaller than the second difference value Δ2, and outputting a data c obtained by performing an offset correction on the processed data b of the previous frame.

In the step S522, the comparison results of the standard difference value Δ and the second difference value Δ2 include:

1. when the offset range of the processed data a of the current frame is small, that is, the offset generated during each level of the multi-level color processing process is within an allowable range, the timing control chip 200 directly outputs the processed data a of the current frame obtained by processing the current frame original data through each level of the multi-level color processing process to the driving chip 300, and the driving chip 300 outputs a corresponding driving signal to the display panel according the data.

2. when the offset range of the processed data a of the current frame is large, the step of performing offset correction on the processed data b of the previous frame includes:

adding or subtracting the first difference value Δ1 to or from the processed data b of the previous frame as a corrected data c, then outputting the corrected data c.

When the offset range of the processed data a of the current frame is large, it is considered that the offset generated during each level of the multi-level color processing process is too large, and exceeds the allowable range; the processed data a of the current frame may not be directly output by the timing control chip 200, otherwise the problem of flickering of the image is likely to occur. At this time, the timing control chip 200 requires to add the first difference value Δ1 (original data difference) to the processed data b of the previous frame as the corrected data c, then the corrected data c is output to the driving chip 300, and the driving chip 300 outputs a corresponding driving signal to the display panel according to the data.

Through the above driving method, when the transmitted image is a static image, the processing effect of the data received by the display panel may be ensured, and the flickering problem of the display panel is also solved.

Referring to FIG. 2, the embodiment of the present disclosure provides a device for driving a display panel.

In an embodiment, the display panel is usually a liquid crystal display panel of an electronic device having a display function such as a television or a computer. Taking a television as an example, the device for driving the display panel is mainly constituted by sequentially connecting a main control chip 100 on the main board of the television, a timing control chip 200 on the control board, and a driving chip 300. The main control chip 100 and the timing control chip 200 are communicatively connected by a Low-Voltage Differential Signaling (LVDS) transmission protocol.

Optionally, the input end of the main control chip 100 is configured to receive current frame original data of the original image signal, and the original image signal is usually input by an antenna or a set top box; the main control chip 100 stores the previous frame original data of the original image signal, transmits a difference between the previous frame original data and the current frame original data, and obtains the difference as a first difference value Δ1; then combines the current frame original data with the first difference value Δ1 and performs encoded transmission in accordance with LVDS protocol.

Among them, the low voltage differential signaling of the LVDS protocol includes 4 pairs of differential signals corresponding to the current frame original data and 1 pair of differential signals corresponding to the first difference value.

Optionally, the color of the current frame original data may also be initially processed before the current frame original data is combined and coded with the first difference value Δ1 for transmission.

Referring to FIG. 3, combining the current frame original data and the first difference value Δ1, and encoding according to LVDS transmission protocol specifically includes: first dividing, by the color, the current frame original data to include a red primary color data, a green primary color data, and a blue primary color data, each of the primary color data having 8 bits, the red primary color data includes AR0 to AR7, the green primary color data includes AG0 to AG7, and the blue primary color data includes AB0 to AB7; dividing, by the color, the first difference value Δ1 to include a red primary color data difference, a green primary color data difference, and a blue primary color data difference, each of the primary color data differences having 3 bits.

In the present embodiment, the first pair of differential signals (0P, 0N) sequentially transmit AR0 to AR5 of red primary color data and AG0 of green primary color data; the second pair of differential signals (1P, 1N) sequentially transmit AG0 to AG5 of green primary color data and AB0-AB1 of blue primary color data; the third pair of differential signals (2P, 2N) sequentially transmit AB2 to AB5 and an enable signal DE of the blue primary color data, and there are two reserved data bits REV between the enable signal DE and AB5 of the blue primary color data; the fourth pair of differential signals (3P, 3N) sequentially transmit AR6 to AR7 of red primary color data, AG6 to AG7 of green primary color data, AB6 to AB7 of blue primary color data, and one reserved data bit REV is left; the fifth pair of differential signals (4P, 4N) are all reserved data bits REV; then, the red primary color data difference, the green primary color data difference, and the blue primary color data difference are jointly transmitted through 7 reserved data bits REV of the fifth pair of differential signals (4P, 4N), 1 reserved data bit REV of the fourth pair of differential signals (3P, 3N), and 1 reserved data bit REV of the third pair of differential signals (2P, 2N).

Further, each primary color data difference may be expressed in binary, then every three bits may represent 8 kinds of data difference (0 to 7), which may be corresponding according to the following coding forms: 000 indicates that the primary color data difference is 0, 001 indicates that the primary color data difference is 1, 010 indicates that the primary color data difference is 2, 011 indicates that the primary color data difference is 3, 100 indicates that the primary color data difference is 4, 101 indicates that the primary color data difference is 5, 110 indicates that the primary color data difference is 6, and 111 indicates that the primary color data difference is 7; when the data difference is greater than 7, it also defaults to 7. For example, when the red primary color data difference is 2, the red primary color data difference transmission bit is correspondingly 010; when the green primary color data difference is 4, the green primary color data difference transmission bit is correspondingly 100; when the blue primary color data difference is 1, the blue primary color data difference transmission bit is correspondingly 001; the first difference value Δ1 is determined by referring to the aforementioned encoding rule for each of the primary color data differences, which is not mentioned here by examples.

After the current frame original data is coded with the first difference value Δ1 according to the above protocol, the coded data is transmitted to the timing controller 200, then the coded data is decoded according to LVDS transmission protocol to separate the current frame original data from the first difference value Δ1, then the current frame original data is subjected to the multi-level color processing, and the first difference value Δ1 is subjected to standard conversion processing.

Multi-level color processing may employ many forms. In the present embodiment, taking the multi-level color processing process including a color processing, a digital gamma processing, and a dither processing which are sequentially performed as an example, this multi-level color processing process is not limited to the form exemplified in the present embodiment. The color processing is configured to improve the color vividness of the transmitted image data; the digital gamma processing digitally adjusts the transmitted image data, edits a gamma curve of the image data to perform nonlinear tone editing on the image, detects a dark portion and a light portion of the image signal, and increases the ratio of the two, thereby improving the image contrast effect; the dither process is configured for de-dithering processing, displaying more gray levels, and making the image transition smoother; when current frame original data is subjected to the above three-level color processing process to obtain the processed data a of the current frame, the previous frame original data is subjected to the above-described three-level color processing to obtain the processed data b of the previous frame.

In the present embodiment, the standard conversion process for the first difference value Δ1 is to first obtain the current gray-level range of the current frame original data; the query operation is performed according to the current gray-scale range based the standard table shown in the following table, then a corresponding standard difference value Δ is obtained.

TABLE 2

| | standard difference value Δ under the gray-scale | | | |
|---|---|---|---|---|
| first difference value Δ1 | 10-50 | 51-130 | 131-190 | 191-255 |
| 0 | 0 | 0 | 0 | 0 |
| 1 | 1 | 1 | 2 | 2 |
| 2 | 2 | 2 | 3 | 3 |
| 3 | 3 | 4 | 5 | 5 |
| 4 | 4 | 5 | 6 | 7 |
| 5 | NA | NA | NA | NA |
| 6 | NA | NA | NA | NA |
| 7 | NA | NA | NA | NA |

In the standard table, NA in the column of each standard difference value Δ represents that the image difference is too large and is not processed; in the present embodiment, the predetermined value Δ0 is set to 5, and when the first difference value Δ1 is greater than or equal to 5, it is considered that the difference in image changes is too large to be processed; that is to say, the current image is a dynamic image, and a final directly output processed data of the current frame is transmitted to the driving chip 300, and the driving chip 300 outputs a corresponding driving signal to the display panel according to the data.

If the first difference value Δ1 is less than 5, it is determined that the current image is a static image, and an output data is determined according to the offset range of the processed data of the current frame is implemented as follows:

comparing a difference between the processed data a of the current frame and the processed data b of the previous frame to obtain a second difference value Δ2;

comparing the magnitude of the standard difference value Δ and the second difference value Δ2, determining that the offset range of the processed data a of the current frame is small when the standard difference value Δ is greater than or equal to the second difference value Δ2, and directly outputting the processed data a of the current frame; determining that the offset range of the processed data a of the current frame is large when the standard difference value Δ is smaller than the second difference value Δ2, and outputting a data c obtained by performing offset correction on the processed data b of the previous frame.

The comparison result of the standard difference value Δ and the second difference value Δ2 include:

1. when the offset range of the processed data a of the current frame is small, that is, the offset generated by the multi-level color processing process in the process of processing the current frame original data is within an allowable range, the timing control chip 200 directly outputs the processed data a of the current frame obtained by processing the current frame original data through multi-level color processing process to the driving chip 300, and the driving chip 300 outputs a corresponding driving signal to the display panel according the data.

2. When the offset range of the processed data a of the current frame is large, performing offset correction on the processed data b of the previous frame is implemented specifically as follows:

adding or subtracting the first difference value Δ1 to or from the processed data b of the previous frame as a corrected data c output.

When the offset range of the processed data a of the current frame is large, it is considered that the offset generated by the multi-level color processing in the process of processing the current frame original data is too large, exceeding the allowable range; the processed data a of the current frame may not be directly used as the output of the timing control chip 200, otherwise the problem of flickering of the image is likely to occur. At this time, the timing control chip 200 requires to add the first difference value Δ1

(original data difference) to the processed data b of the previous frame as the corrected data c to output to the driving chip 300, and the driving chip 300 outputs a corresponding driving signal to the display panel according to the data.

Through the above driving device, when the transmitted image is a static image, the processing effect of the data received by the display panel may be ensured, and the flickering problem of the display panel is also solved.

In an embodiment, similarly, based on the same application concept, the embodiment of the present disclosure further provides a display device, the display device includes a display panel and the device for driving the display panel as described above. The structure, the working principle, and the beneficial effects of the driving device of display panel are all referred to the foregoing embodiments, and are not described herein again.

The above mentioned is only the optional embodiment of the present disclosure, which does not limit the patent scope of the present disclosure, and any equivalent structure transformation made by using the specification and the drawings of the present disclosure or direct/indirect applications in other related technical fields should be contained in the scope of patent protection in a similar way.

What is claimed is:

1. A method for driving a display panel, wherein the method comprises steps of:

receiving an original image signal, and comparing a difference between a current frame original data and a previous frame original data of the original image signal to obtain a first difference value;

performing a multi-level color processing on the current frame original data to obtain a processed data of the current frame; meanwhile converting the first difference value to a standard difference value through a standard conversion;

determining whether the standard difference value is greater than or equal to a predetermined value, and if yes, outputting the processed data of the current frame; if not, determining an output data according to an offset range of the processed data of the current frame; and driving the display panel according to the output data;

wherein the step of determining an output data according to the offset range of the processed data of the current frame comprises:

comparing a difference between the processed data of the current frame and a processed data of the previous frame to obtain a second difference value; and comparing a magnitude of the standard difference value with that of the second difference value, determining that the offset range of the processed data of the current frame is small when the standard difference value is greater than or equal to the second difference value, and directly outputting the processed data of the current frame; determining that the offset range of the processed data of the current frame is large when the standard difference value is smaller than the second difference value, and outputting a data obtained by performing an offset correction on the processed data of the previous frame.

2. The method according to claim 1, wherein the step of outputting a data obtained by performing an offset correction on the processed data of the previous frame comprises:

adding or subtracting the first difference value to or from the processed data of the previous frame as a corrected data, and outputting the corrected data.

3. The method according to claim 1, wherein the step of performing a multi-level color processing on the current frame original data to obtain a processed data of the current frame comprises:

a color processing, performing the color processing on the current frame original data to obtain a first-level processed data of the current frame;

a digital gamma processing, performing the digital gamma processing on the current frame original data to obtain a second-level processed data of the current frame; and a dither processing, performing the dither processing on the current frame original data to obtain a third-level processed data of the current frame.

4. The method according to claim 3, wherein the current frame original data is subjected to the color processing, the digital gamma processing, and the dither processing to obtain the processed data of the current frame; and the previous frame original data is subjected to the above three-level color processing to obtain the processed data of the previous frame.

5. The method according to claim 3, wherein the step of the digital gamma processing comprises:

digitally adjusting a transmitted image data, and editing a gamma curve of the image data to perform nonlinear tone editing on the image; and detecting a dark portion and a light portion in the image signal, and increasing the ratio of the two.

6. The method according to claim 1, wherein the step of converting the first difference value to a standard difference value through a standard conversion, comprises:

obtaining a current gray-scale range of the current frame original data; and obtaining the standard difference value corresponding to the first difference value by querying a standard table according to the current gray-scale range and the first difference value.

7. The method according to claim 1, wherein after the step of receiving an original image signal, and comparing a difference between a current frame original data and a previous frame original data of the original image signal to obtain a first difference value, the method further comprises:

combining the current frame original data and the first difference value, and transmitting the combined data according to a preset protocol code, then decoding the combined data to separate the current frame original data from the first difference value.

8. The method according to claim 7, wherein the step of combining the current frame original data and the first difference value, and transmitting the combined data according to a preset protocol code, then decoding the combined data to separate the current frame original data from the first difference value, comprises: first dividing, by the color, the current frame original data to comprise a red primary color data, a green primary color data, and a blue primary color data, each of the primary color data comprising 8 bits, wherein the red primary color data comprises AR0 to AR7, the green primary color data comprises AG0 to AG7, and the blue primary color data comprises AB0 to AB7; dividing, by the color, the first difference value to include a red primary color data difference, a green primary color data difference, and a blue primary color data difference, each of the primary color data differences comprising 3 bits.

9. The method according to claim 7, wherein the predetermined protocol is a low voltage differential signaling transmission protocol, and the low voltage differential signaling comprises 4 pairs of differential signals corresponding to the current frame original data and 1 pair of differential signals corresponding to the first difference value.

10. A device for driving a display panel, wherein the device comprises:

a main control chip, configured to receive an original image signal, and compare a difference between a current frame original data and a previous frame original data of the original image signal to obtain a first difference value; combine the current frame original data and the first difference value, and transmit the combined data according to a predetermined code;

a timing control chip, communicatively connected to the main control chip through the predetermined protocol, and configured to: receive the combined data and decode the combined data to separate the current frame original data from the first difference value; perform a multi-level color processing on the current frame original data to obtain a processed data of the current frame; convert the first difference value to a standard difference value through a standard conversion; determine whether the standard difference value is greater than or equal to a predetermined value, and if yes, output the processed data of the current frame; if not, compare a difference between the processed data of the current frame and the processed data of the previous frame to obtain a second difference value; compare a magnitude of the standard difference value and that of the second difference value, determine that an offset range of the processed data of the current frame is small when the standard difference value is greater than or equal to the second difference value, and directly output the processed data of the current frame; determine that the offset range of the processed data of the current frame is large when the standard difference value is smaller than the second difference value, and add or subtract the first difference value to or from the processed data of the previous frame as a corrected data, and output the corrected data; and a driving chip, connected to an output end of the timing control chip, and configured to drive the display panel according to data output by the timing control chip.

11. The device according to claim 10, wherein the standard conversion process comprises obtaining a current gray-scale range of the current frame original data, and obtaining a standard difference value corresponding to the first difference value by querying a standard table according to the current gray-scale range and the first difference value.

12. The device according to claim 10, wherein the predetermined protocol is a low voltage differential signaling transmission protocol, and the low voltage differential signaling comprises 4 pairs of differential signals corresponding to the current frame original data and 1 pair of differential signals corresponding to the first difference value.

13. A display device, wherein the display device comprises a display panel and a device for driving a display panel; the device comprises:

a main control chip, configured to receive an original image signal, and compare a difference between a current frame original data and a previous frame original data of the original image signal to obtain a first difference value; combine the current frame original data and the first difference value, and transmit the combined data according to a predetermined code;

a timing control chip, communicatively connected to the main control chip through the predetermined protocol, and configured to: receive the combined data and decode the combined data to separate the current frame original data from the first difference value; perform a multi- level color processing on the current frame original data to obtain a processed data of the current frame; convert the first difference value to a standard difference value through a standard conversion; determine whether the standard difference value is greater than or equal to a predetermined value, and if yes, output the processed data of the current frame; if not, compare a difference between the processed data of the current frame and the processed data of the previous frame to obtain a second difference value; compare a magnitude of the standard difference value with that of the second difference value, determine that an offset range of the processed data of the current frame is small when the standard difference value is greater than or equal to the second difference value, and directly output the processed data of the current frame; determine that the offset range of the processed data of the current frame is large when the standard difference value is smaller than the second difference value, and add or subtract the first difference value to or from the processed data of the previous frame as a corrected data, and output the corrected data; and a driving chip, connected to an output end of the timing control chip, and configured to drive the display panel according to data output by the timing control chip.

14. The display device according to claim 13, wherein the standard conversion process comprises obtaining a current gray-scale range of the current frame original data, and obtaining a standard difference value corresponding to the first difference value by querying a standard table according to the current gray-scale range and the first difference value.

15. The display device according to claim 13, wherein the predetermined protocol is a low voltage differential signaling transmission protocol, and the low voltage differential signaling comprises 4 pairs of differential signals corresponding to the current frame original data and 1 pair of differential signals corresponding to the first difference value.

16. The display device according to claim 13, wherein the step of the timing controller being configured to determine the output data according to the offset range of the processed data of the current frame comprises:

comparing the difference between the processed data of the current frame and the processed data of the previous frame to obtain the second difference value; and comparing the magnitude of the standard difference value with that of the second difference value, determining that the offset range of the processed data of the current frame is small when the standard difference value is greater than or equal to the second difference value, and directly outputting the processed data of the current frame; determining that the offset range of the processed data of the current frame is large when the standard difference value is smaller than the second difference value, and outputting the data obtained by performing offset correction on the processed data of the previous frame.

17. The display device according to claim 13, wherein the step of the timing controller being configured to output the data obtained by performing offset correction on the processed data of the previous frame comprises:

adding or subtracting the first difference to or from the processed data of the previous frame as the corrected data, and outputting the corrected data.

* * * * *